United States Patent [19]

Vits

[11] 4,058,244

[45] Nov. 15, 1977

[54] AIR CUSHION NOZZLE

[75] Inventor: Hilmar Vits, Leichlingen, Germany

[73] Assignee: Vits-Maschinenbau GmbH, Langenfeld, Germany

[21] Appl. No.: 769,717

[22] Filed: Feb. 17, 1977

[30] Foreign Application Priority Data

Mar. 27, 1976 Germany ..... 2613135

[51] Int. Cl.[2] ..... B65H 17/32

[52] U.S. Cl. ..... 226/97; 34/156

[58] Field of Search ..... 226/7, 97; 34/156

[56] References Cited

U.S. PATENT DOCUMENTS

| | | | |
|---|---|---|---|
| 3,549,070 | 12/1970 | Frost | 226/97 |
| 3,982,327 | 9/1976 | Kurie | 34/156 |

*Primary Examiner*—Richard A. Schacher

[57] ABSTRACT

An air cushion nozzle for a device for conveying a web in suspension on an air cushion comprising a housing with two opposed walls having bent legs at the ends thereof resting on respective baffle plate portions supported on the housing. The legs have spaced semi-circular recesses therein forming tongues between the recesses which are in contact with the baffle plate portions to form two rows of discharge outlets for jets of air at the recesses extending toward one another in parallel to form the air cushion. The baffle plate portions can be joined together by a perforate plate. The baffle plate means can be bent at different angles to produce different angles of inclination for the jets of air produced at the two rows of discharge outlets.

10 Claims, 1 Drawing Figure

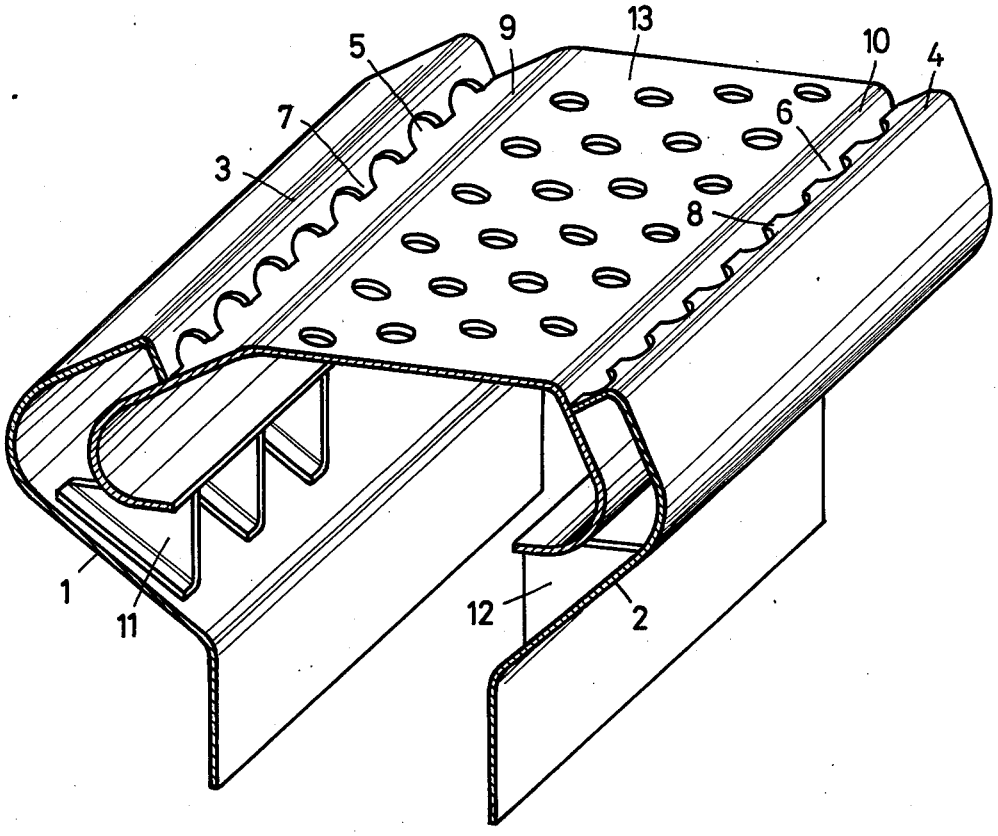
5
9
13
10
4
7
6
3
8
1
11
12
2

AIR CUSHION NOZZLE

FIELD OF THE INVENTION

The invention relates to an air cushion nozzle for a device for conveying a web in suspension, which nozzle has two opposed rows of holes having blowing directions directed towards each other in parallel to form an air cushion.

BACKGROUND

Various types of air cushion nozzles are known. In one type, the blast air issues from opposed slots, whereas in a second type the blast air issues from holes arranged in rows. Air cushion nozzles with outlet slots have the disadvantage that the suspension properties cannot be exactly predetermined since the width of the opposed slots can differ, for example, due to manufacture or due to the effect of heat during operation. Various outlet cross-sections act so that air issues from the air cushion in the direction of the slot, the blast air from which achieves the least resistance. However, if the direction of discharge cannot be predetermined, the suspension properties of such an air cushion nozzle then cannot be exactly predetermined either. To remove this disadvantage, attempts have been made to arrange spacer elements in the form of rivets distributed longitudinally of the slot. Irrespective of the fact that the width of the slot in the large areas cannot be exactly predetermined, the mounting of spacer elements results in a considerable additional expense in manufacture.

The deficiency of the variation of the cross-section does not arise with rows of holes in place of slots, but other problems are produced. Namely, it is difficult to combine the individual jets to form a jet corresponding to that of a slot nozzle. The joining of individual jets directly after discharge from the holes generally provided in a hole plate causes difficulties. The suspension properties of such a nozzle are, therefore, not an optimum.

SUMMARY OF THE INVENTION

An object of the invention is to provide an air cushion nozzle of the above mentioned type which can be exactly predetermined with regard to suspension properties and is economical to manufacture.

This object is met according to the invention by an air cushion nozzle of the above type in which the holes of each row of a common baffle plate are formed on each side by means which face the center of the nozzle and in the remaining area by means at the edges of recesses formed in a leg of the nozzle housing and separated from each other by means of tongues in the leg, which leg is subjected to initial stress and is supported by said tongues on said baffle plate.

The air cushion nozzle according to the invention combines the advantages of an air cushion nozzle having slots and an air cuahion nozzle having rows of holes, since the baffle plate guarantees that the individual jets issuing from the holes are conveyed together directly after their outlet to form a closed jet corresponding to a slot jet. As the legs forming the edge recesses are subjected to initial stress and are supported by the tongues on the baffle plate, the outlet cross-section of the holes is exactly defined and cannot change even in operation. The cost of manufacture is low since additional distance elements need not be installed.

It is particularly favorable for bringing the individual jets together if the edge recesses are in the form of semi-circular holes.

The baffle plates are preferably connected to one another in a manner known per se, e.g. by a plate, especially a perforate plate.

According to one embodiment of the invention, the legs can be secured to the baffle plate. The initial stress of the legs can thus be easily applied.

As a defined flow of air from the air cushion formed between the slot jets cannot be guaranteed in every case even with a constant outlet cross-section, (for example, due to the continuous web running over the nozzle in the form of waves so that the gap at one slot nozzle is larger than at the other slot nozzle and consequently the resistance against air flow out of the air cushion varies), the angle of inclination in the blowing direction of a slot jet can deviate from that of the other slot jet, in particular, by two- to four-fold. This embodiment of the invention is of particular significance. The flow direction can be exactly predetermined with this embodiment. The constant outlet cross-section of the nozzle holes guarantees that the resistance which is determined by the different angles of inclination of the blast jets and which is opposed to air flow out of the air cushion, is not compensated by differences in the force of the blast jet.

BRIEF DESCRIPTION OF THE DRAWING

The invention is described hereafter in greater detail with reference to the appended drawing, the sole FIGURE of which is an isometric illustration of one embodiment thereof.

DETAILED DESCRIPTION

Referring to the drawing, therein is seen a nozzle housing with walls 1, 2 having legs 3, 4 bent obliquely downwards at the upper edges of the walls. The legs 3, 4 are supported by means of tongues 7, 8 formed between semi-circular holes 5, 6 on the flat surface of baffle plate portions 9, 10. The legs 3, 4 are subjected to initial stress which is applied by the housing walls 1, 2. The baffle plate portions 9, 10 are secured at their lower surfaces to the housing walls 1, 2 by connecting elements 11, 12. The upper surfaces of the baffle plate portions 9, 10 are connected to each other by a perforate plate 13.

Blast air is conveyed in the housing formed by the walls 1, 2 and issues through the holes 5, 6 of the two rows of holes. The blast jets flowing along the length of the baffle plate portions 9, 10 join directly after being discharged to form a jet constituting a closed air curtain. The two jets are directed at an inclination towards one another. The blast air conveyed in the housing also issues through the holes in the perforate plate 13. The blast air issuing from the holes in the plate 13 and from the holes 5, 6 forms an air cushion which is covered from above by a continuous web to be conveyed in suspension on the air cushion.

It is possible within the scope of the invention for the angle of inclination of the blast jets associated with each row of holes to be equal to that of the blast jets from the other row of holes. As the outlet cross-sections can be exactly predetermined on manufacture and do not change during operation, the amount of air flowing out for the air cushion through the two rows of holes is equal. The flow direction is fixed in the invention whereas in the known air cushion nozzles having slots, (the cross-section of which changes for manufacturing or operational reasons), the flowing direction cannot be predetermined. The invention also permits the angle of inclination of the blast jets of one row of holes to be greater than that of the other row of holes, as represented in the illustrated embodiment, or permits the cross-section of one row of holes to be larger than that of the other row of holes. Both features can be combined. It is then possible with these features to predetermine the main flow direction.

What is claimed is:

1. An air cushion nozzle for a device for conveying a web in suspension on an air cushion, said nozzle comprising a housing including two opposed walls with bent legs thereon, said legs having spaced recesses therein forming tongues between said recesses, barfle plate means supported on said housing for supporting each leg, said legs being biased, so that said tongues on said legs being in contact with said baffle plate means to form two rows of discharge outlets for jets of air at said recesses extending towards one another in parallel for form the air cushion.

2. An air cushion nozzle as claimed in claim 1 wherein said recesses are semi-circular.

3. An air cushion nozzle as claimed in claim 2 wherein said legs have free edges, said recesses being formed in said legs at said free edges.

4. An air cushion nozzle as claimed in claim 1 wherein said baffle plate means has a smooth flat surface which is contacted by said tongues.

5. An air cushion nozzle as claimed in claim 4 comprising a perforate plate joining together the baffle plate means associated with the two rows of discharge outlets.

6. An air cushion nozzle as claimed in claim 5 wherein said baffle plate means extend at an angle relative to said perforate plate.

7. An air cushion nozzle as claimed in claim 1 wherein said legs are secured to said baffle plate means.

8. An air cushion nozzle as claimed in claim 1 wherein said baffle plate means are bent at different angles to produce different angles of inclination for the jets of air produced at the two rows of discharge outlets.

9. An air cushion nozzle as claimed in claim 8 wherein said inclination at one row is two to four times the inclination at the other row.

10. An air cushion nozzle as claimed in claim 1 comprising support plates supporting said baffle plate means on said housing.

* * * * *